US007130569B2

(12) United States Patent
Goodman et al.

(10) Patent No.: US 7,130,569 B2
(45) Date of Patent: Oct. 31, 2006

(54) POLYANILINE FILLED POLYIMIDE WELDABLE INTERMEDIATE TRANSFER COMPONENTS

(75) Inventors: Donald J. Goodman, Pittsford, NY (US); Satish R. Parikh, Rochester, NY (US); Edward F. Grabowski, Webster, NY (US); Matthew J. Torpey, Pittsford, NY (US); M John Hinckel, Rochester, NY (US); Michael S. Roetker, Webster, NY (US); Markus R. Silvestri, Fairport, NY (US); John J. Darcy, III, Webster, NY (US); David W. Martin, Walworth, NY (US); Scott J. Griffin, Fairport, NY (US); Felix J. Santana, Webster, NY (US); Robert J. Flanagan, Fairport, NY (US); Joellen Simone, Ontario, NY (US); Robert C. U. Yu, Webster, NY (US); John P. Kerwawycz, Henrietta, NY (US); Satchidanand Mishra, Webster, NY (US)

(73) Assignee: Xerox Corporation, Stamford, CT (US)

( * ) Notice: Subject to any disclaimer, the term of this patent is extended or adjusted under 35 U.S.C. 154(b) by 109 days.

(21) Appl. No.: 10/884,773

(22) Filed: Jul. 2, 2004

(65) Prior Publication Data

US 2006/0002747 A1 Jan. 5, 2006

(51) Int. Cl.
*G03G 15/01* (2006.01)
*G03G 15/20* (2006.01)

(52) U.S. Cl. ..... 399/302; 399/308; 428/327; 428/473.5

(58) Field of Classification Search ..... 399/302, 399/303, 308, 309, 312, 313; 252/500; 430/48, 430/126; 428/421, 422, 323, 327, 328, 473.5
See application file for complete search history.

(56) References Cited

U.S. PATENT DOCUMENTS

| | | | | |
|---|---|---|---|---|
| 5,079,121 | A * | 1/1992 | Facci et al. | 430/62 |
| 5,382,486 | A * | 1/1995 | Yu et al. | 430/56 |
| 6,060,116 | A * | 5/2000 | Kulkarni et al. | 427/213.3 |
| 6,397,034 | B1 | 5/2002 | Tarnawskyj et al. | 399/308 |
| 6,489,020 | B1 * | 12/2002 | Caruthers et al. | 428/327 |
| 6,602,156 | B1 | 8/2003 | Schlueter, Jr. | 474/253 |
| 6,660,441 | B1 | 12/2003 | Yu | 430/58.05 |
| 6,738,595 | B1 * | 5/2004 | Hsieh et al. | 399/302 |
| 2003/0008098 | A1 * | 1/2003 | Yuan et al. | 428/58 |

(Continued)

FOREIGN PATENT DOCUMENTS

JP 08211643 A * 8/1996

(Continued)

OTHER PUBLICATIONS

Dupont, Kapton KJ, www.dupont.com/kapton, Dupont High Performance Films, pp. 8-11.

*Primary Examiner*—Robert Beatty
(74) *Attorney, Agent, or Firm*—Annette L. Bade

(57) ABSTRACT

A weldable intermediate transfer belt having a substrate with a homogeneous composition of polyaniline in an amount of from about 2 to about 25 percent by weight of total solids, and a thermoplastic polyimide in an amount of from about 75 to about 98 percent by weight of total solids, and the polyaniline has a particle size of from about 0.5 to about 5.0 microns, and an apparatus for forming images on a recording medium and incorporating the intermediate transfer belt.

21 Claims, 4 Drawing Sheets

U.S. PATENT DOCUMENTS

2004/0247340 A1* 12/2004 Miura et al. ..... 399/176
2005/0145832 A1* 7/2005 Wessling et al. ..... 252/500
2006/0002746 A1* 1/2006 Darcy et al. ..... 399/302

FOREIGN PATENT DOCUMENTS

JP 09176329 A * 7/1997
JP 2000122435 A * 4/2000
JP 2001109277 A * 4/2001
JP 2004157474 A * 6/2004

* cited by examiner

FIG. 2
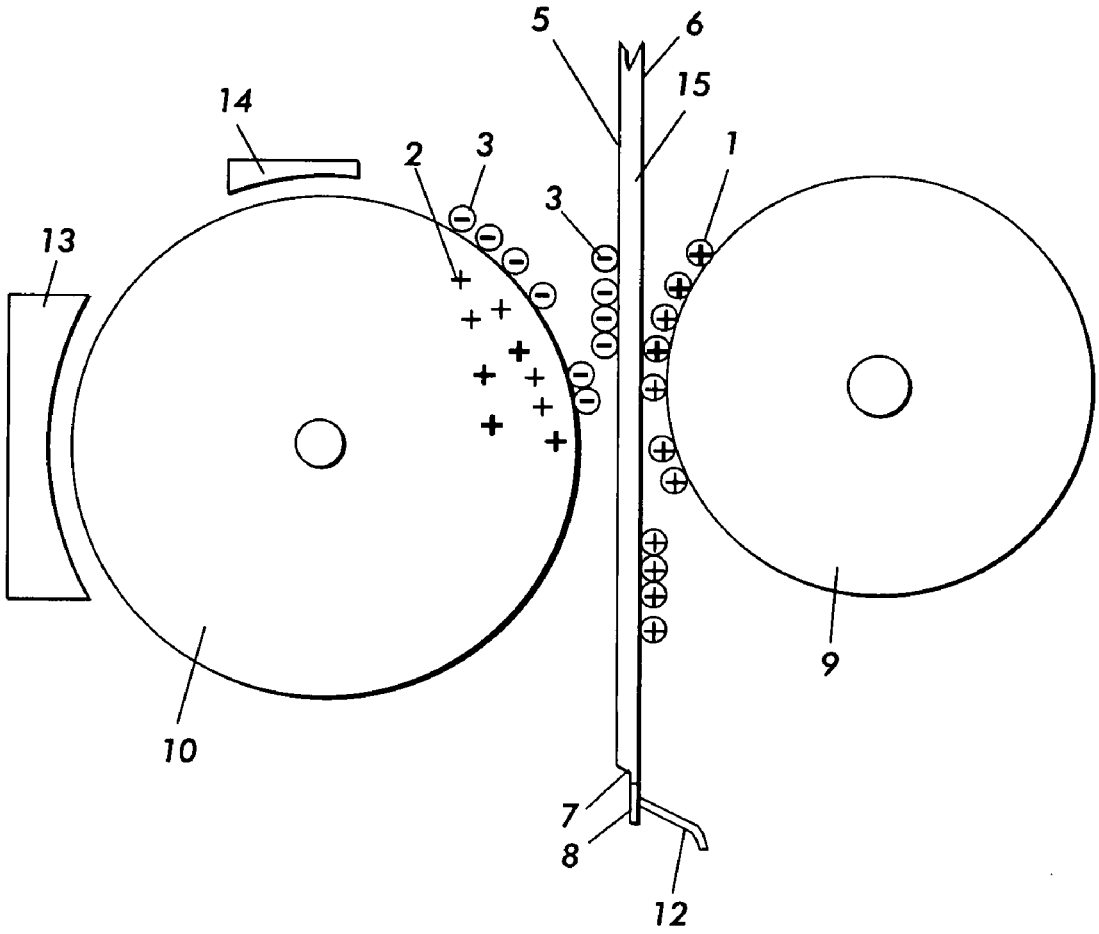
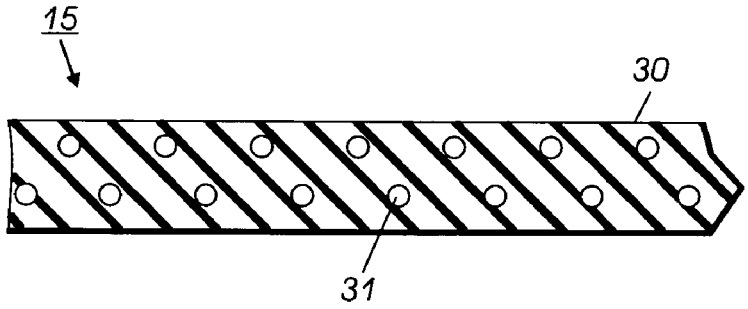
FIG. 3

POLYANILINE FILLED POLYIMIDE WELDABLE INTERMEDIATE TRANSFER COMPONENTS

CROSS-REFERENCE TO RELATED APPLICATIONS

Attention is directed to U.S. patent application Ser. No. 10/825,453, now U.S. Pat. No. 7,031,647, filed Apr. 14, 2004, entitled "Imageable Seamed Belts With Lignin Sulfonic Acid Doped Polyaniline" and to U.S. patent application Ser. No. 10/884,289, filed concurrently herewith, and entitled "Weldable Polyimide Intermediate Transfer Belt and Process for Welding Thereof". The disclosures of these applications are hereby incorporated by reference in their entirety.

BACKGROUND

Herein are described intermediate transfer members, and more specifically, intermediate transfer members useful in transferring a developed image in an electrostatographic, for example xerographic, including digital, image on image, and the like, machines or apparatuses. In embodiments, there are selected intermediate transfer members comprising a layer or substrate comprising a filled polymer, such as a filled polyimide, and for example, a polyaniline filled polyimide. In embodiments, the resistivity of the polyaniline filled polyimide is relatively high. In embodiments, the polyaniline has a relatively small particle size. In embodiments, a combination of polyaniline and polyimide allows for a weldable intermediate transfer member to be prepared. In embodiments, the weldable intermediate transfer member dispenses with the need for puzzle cut seams, which are highly labor intensive. The net manufacturing cost to produce the weldable intermediate transfer members, in embodiments, is lowered. In embodiments, the weldable intermediate transfer members are imageable.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles, which are commonly referred to as toner. Generally, the electrostatic latent image is developed by bringing a developer mixture into contact therewith. The developer mixture can comprise a dry developer mixture, which usually comprises carrier granules having toner particles adhering triboelectrically thereto, or a liquid developer material, which may include a liquid carrier having toner particles, dispersed therein. The developer material is advanced into contact with the electrostatic latent image and the toner particles are deposited thereon in image configuration. Subsequently, the developed image is transferred to a copy sheet. It is advantageous to transfer the developed image to a coated intermediate transfer web, belt or component, and subsequently transfer with very high transfer efficiency the developed image from the intermediate transfer member to a permanent substrate. The toner image is subsequently usually fixed or fused upon a support, which may be the photosensitive member itself, or other support sheet such as plain paper.

In electrostatographic printing machines wherein the toner image is electrostatically transferred by a potential between the imaging member and the intermediate transfer member, the transfer of the toner particles to the intermediate transfer member and the retention thereof should be as complete as possible so that the image ultimately transferred to the image receiving substrate will have a high resolution. Substantially 100% toner transfer occurs when most or all of the toner particles comprising the image are transferred and little residual toner remains on the surface from which the image was transferred.

Intermediate transfer members allow for positive attributes such as enabling high throughput at modest process speeds, improving registration of the final color toner image in color systems using synchronous development of one or more component colors using one or more transfer stations, and increasing the range of final substrates that can be used. However, a disadvantage of using an intermediate transfer member is that a plurality of transfer steps is required allowing for the possibility of charge exchange occurring between toner particles and the transfer member which ultimately can lead to less than complete toner transfer. The result is low-resolution images on the image receiving substrate and image deterioration. When the image is in color, the image can additionally suffer from color shifting and color deterioration. In addition, the incorporation of charging agents in liquid developers, although providing acceptable quality images and acceptable resolution due to improved charging of the toner, can exacerbate the problem of charge exchange between the toner and the intermediate transfer member.

In embodiments, the resistivity of the intermediate transfer member is within a range to allow for sufficient transfer. It is also desired that the intermediate transfer member have a controlled resistivity, wherein the resistivity is virtually unaffected by changes in humidity, temperature, bias field, and operating time. In addition, a controlled resistivity is important so that a bias field can be established for electrostatic transfer. It is desired that the intermediate transfer member not be too conductive as air breakdown can possibly occur.

Attempts at controlling the resistivity of intermediate transfer members have been accomplished by, for example, adding conductive fillers such as ionic additives and/or carbon black to the outer layer. For example, U.S. Pat. No. 6,397,034 discloses use of fluorinate carbon filler in a polyimide intermediate transfer member layer. However, there are problems associated with the use of such additives. In particular, undissolved particles frequently bloom or migrate to the surface of the polymer and cause an imperfection in the polymer. This leads to nonuniform resistivity, which in turn, causes poor antistatic properties and poor mechanical strength. The ionic additives on the surface may interfere with toner release. Furthermore, bubbles may appear in the conductive polymer, some of which can only be seen with the aid of a microscope, others of which are large enough to be observed with the naked eye. These bubbles provide the same kind of difficulty as the undissolved particles in the polymer, namely poor or nonuniform electrical properties and poor mechanical properties.

In addition, the ionic additives themselves are sensitive to changes in temperature, humidity, and operating time. These sensitivities often limit the resistivity range. For example, the resistivity usually decreases by up to two orders of magnitude or more as the humidity increases from 20% to 80% relative humidity. This effect limits the operational or process latitude.

Moreover, ion transfer can also occur in these systems. The transfer of ions leads to charge exchanges and insufficient transfers, which in turn causes low image resolution and image deterioration, thereby adversely affecting the copy quality. In color systems, additional adverse results include color shifting and color deterioration. Ion transfer also increases the resistivity of the polymer member after repetitive use. This can limit the process and operational latitude and eventually the ion-filled polymer member will be unusable.

Use of polyaniline filler in a polyimide has been disclosed in U.S. Pat. No. 6,602,156. However, the patent discloses a polyaniline filled polyimide puzzle cut seamed belt. The use of the polyaniline filled polyimide puzzle cut seamed belt provides a belt, which has improved mechanical and electrical properties over other filled belts. However, manufacture of the puzzle cut seamed belt is labor intensive and very costly, and the puzzle cut seam, in embodiments, is sometimes weak. The manufacturing process for a puzzle cut seamed belt requires a lengthy high temperature and high humidity-conditioning step. For the conditioning step, each individual belt is rough cut, rolled up, and placed in a conditioning chamber that is environmentally controlled at 45° C. and 85 percent relative humidity, for approximately 20 hours. Another 3 hours is required to bring the belt back down to ambient conditioning to prevent condensation and watermarks before it can be removed from the conditioning chamber. This conditioning operation is required to bring the belt into the proper resistivity range for use in a color printer. The conditioning step necessitates that sheets of the belt material be cut roughly to size prior to conditioning. This makes it virtually impossible to automate the manufacturing process for puzzle cut seamed belts. Without the 24-hour high temperature and high humidity conditioning step, the belt's electrical properties and hence image quality, will not be stable for several months.

Also, after the 1-day high temperature and high humidity-conditioning step, puzzle cut seamed belts are then additionally prepared by using tape or glue at the seam. This step is followed by the highly labor intensive step of having an operator manually zip the puzzle cut pieces together with their fingers. Once seamed, the strength of the puzzle cut seam is limited by the strength of the puzzle cut piece necks. Most belt break failures occur when the puzzle necks break.

Smaller circumference intermediate transfer belts are made by extrusion or spin casting. However, extrusion and spin casting are not cost effective for belts requiring larger circumferences. Larger circumference belts are necessary in color tandem engine architecture machines.

Therefore, it is desired to provide a weldable intermediate transfer belt, which has improved transfer ability and improved copy quality. It is also desired to provide a weldable intermediate transfer belt that does not have puzzle cut seams, but instead, has a weldable seam, thereby providing a belt that can be manufactured without such labor intensive steps as manually piecing together the puzzle cut seam with fingers, and without the lengthy high temperature and high humidity conditioning steps. Further, it is desired to provide a belt that has a stronger seam than current puzzle cut seams. It is also desired to provide a higher circumference weldable belt for color machines.

SUMMARY

The present invention provides, in embodiments, a weldable intermediate transfer belt comprising a substrate comprising a homogeneous composition comprising polyaniline in an amount of from about 2 to about 25 percent by weight of total solids, and a thermoplastic polyimide in an amount of from about 75 to about 98 percent by weight of total solids, wherein said polyaniline has a particle size of from about 0.5 to about 5.0 microns.

The present invention further includes, in embodiments, a weldable intermediate transfer belt comprising a substrate comprising a homogeneous composition consisting essentially of polyaniline in an amount of from about 2 to about 25 percent by weight of total solids, and a thermoplastic polyimide in an amount of from about 75 to about 98 percent by weight of total solids, and wherein said polyaniline has a particle size of from about 0.5 to about 5.0 microns.

In addition, the present invention provides, in embodiments, an apparatus for forming images on a recording medium comprising a charge-retentive surface to receive an electrostatic latent image thereon; a development component to apply toner to the charge-retentive surface to develop the electrostatic latent image and to form a developed image on the charge retentive surface; a weldable intermediate transfer belt to transfer the developed image from the charge retentive surface to a substrate, wherein the intermediate transfer belt comprises a substrate comprising a homogeneous composition comprising polyaniline in an amount of from about 2 to about 25 percent by weight of total solids, and a thermoplastic polyimide in an amount of from about 75 to about 98 percent by weight of total solids, and wherein said polyaniline has a particle size of from about 0.5 to about 5.0 microns; and a fixing component.

BRIEF DESCRIPTION OF THE DRAWINGS

For a better understanding of the present invention, reference may be had to the accompanying figures.

FIG. 2 is a schematic view of an image development system containing an intermediate transfer member.

FIG. 3 is an illustration of an embodiment, wherein the substrate of the intermediate transfer member comprises a polyaniline filled polyimide material.

DETAILED DESCRIPTION

Herein are described intermediate transfer members comprising polyaniline filled polyimide layers or substrates. In embodiments, the polyaniline filler has a relatively small particle size. In embodiments, the resistivity of the intermediate transfer member is relatively high.

The intermediate transfer members are weldable and do not require the presence of puzzle cut seams. Instead, the seam of the polyaniline filled polyimide belt is weldable. Also, the weldable polyaniline filled polyimide belts do not require a conditioning step, and may be ultrasonically welded to produce a seam that is as strong or stronger than the polyaniline filled polyimide material itself. The formulation of polyaniline filled polyimide conditions fully at room temperature and humidity within several hours. Consequently, no high temperature and high humidity conditioning is necessary. Also, an entire roll of polyaniline filled polyimide can be loaded into an automated manufacturing device such as an automated ultrasonically welded seam manufacturing line. Consequently, weldable polyaniline filled polyimide belts can be made at a much lower cost than traditional puzzle cut seamed polyimide belts, and other seaming technologies. The present inventors have found that varying the proportion of polyaniline controls the sheet resistivity and can be set to match current intermediate transfer belt properties or to satisfy the requirements for a future intermediate transfer belt. In addition, the present inventors have determined that varying the average particle size of the polyaniline varies the roughness of the material's surface.

In addition, the current weldable polyaniline filled polyimide belts dispense with the requirement for use of carbon blacks and other fillers, although in embodiments, carbon black or other fillers can be added.

Figure 1:
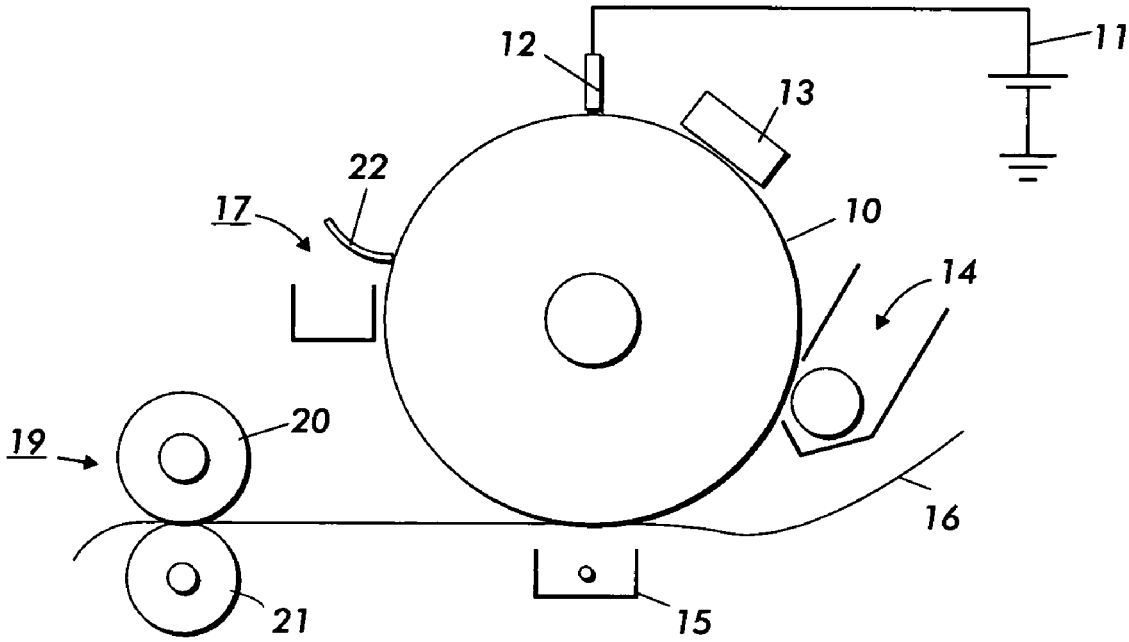
FIG. 1 is an illustration of a general electrostatographic apparatus.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles, which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

FIG. 2 demonstrates an embodiment of the present invention and depicts an intermediate transfer member 15 positioned between an imaging member 10 and a transfer roller 9. The imaging member 10 is exemplified by a photoreceptor drum. However, other appropriate imaging members may include other electrostatographic imaging receptors such as ionographic belts and drums, electrophotographic belts, and the like.

In the multi-imaging system of FIG. 2, each image being transferred is formed on the imaging drum by image forming station 13. Each of these images is then developed at developing station 14 and transferred to intermediate transfer member 15. Each of the images may be formed on the photoreceptor drum 10 and developed sequentially and then transferred to the intermediate transfer member 15. In an alternative method, each image may be formed on the photoreceptor drum 10, developed, and transferred in registration to the intermediate transfer member 15. In a preferred embodiment of the invention, the multi-image system is a color copying system. In this color copying system, each color of an image being copied is formed on the photoreceptor drum 10. Each color image is developed and transferred to the intermediate transfer member 15. In the alternative method, each color of an image may be formed on the photoreceptor drum 10, developed, and transferred in registration to the intermediate transfer member 15.

Subsequent to development, the charged toner particles 3 from the developing station 14 are attracted and held by the photoreceptor drum 10 because the photoreceptor drum 10 possesses a charge 2 opposite to that of the toner particles 3. In FIG. 2, the toner particles are shown as negatively charged and the photoreceptor drum 10 is shown as positively charged. These charges can be reversed, depending on the nature of the toner and the machinery being used. In a preferred embodiment, the toner is present in a liquid developer. However, the present invention, in embodiments, is useful for dry development systems also.

A biased transfer roller 9 positioned opposite the photoreceptor drum 10 has a higher voltage than the surface of the photoreceptor drum 10. Biased transfer roller 9 charges the backside 6 of intermediate transfer member 15 with a positive charge. In an alternative embodiment of the invention, a corona or any other charging mechanism may be used to charge the backside 6 of the intermediate transfer member 15.

The negatively charged toner particles 3 are attracted to the front side 5 of the intermediate transfer member 15 by the positive charge 1 on the backside 6 of the intermediate transfer member 15.

The intermediate transfer member may be in the form of a sheet, web or belt as it appears in FIG. 2, or in the form of a roller or other suitable shape. In a preferred embodiment of the invention, the intermediate transfer member is in the form of a belt. In another embodiment of the invention, not shown in the Figures, the intermediate transfer member may be in the form of a sheet.

After the toner latent image has been transferred from the photoreceptor drum 10 to the intermediate transfer member 15, the intermediate transfer member may be contacted under heat and pressure to an image receiving substrate such as paper. The toner image on the intermediate transfer member 15 is then transferred and fixed, in image configuration, to a substrate such as paper.

FIG. 3 shows a sectional view of an example of an intermediate transfer member 15 according to an embodiment of the present invention and depicts a substrate 30. The polyaniline fillers 31 are depicted as being in a dispersed phase in the polyimide material. The intermediate transfer member 15 can be a single layer as shown in FIG. 3, wherein the substrate comprises the polyaniline filled polyimide or it can be several layers, for example from about 2 to about 5, of a polyaniline filled polyimide material.

Figure 5:
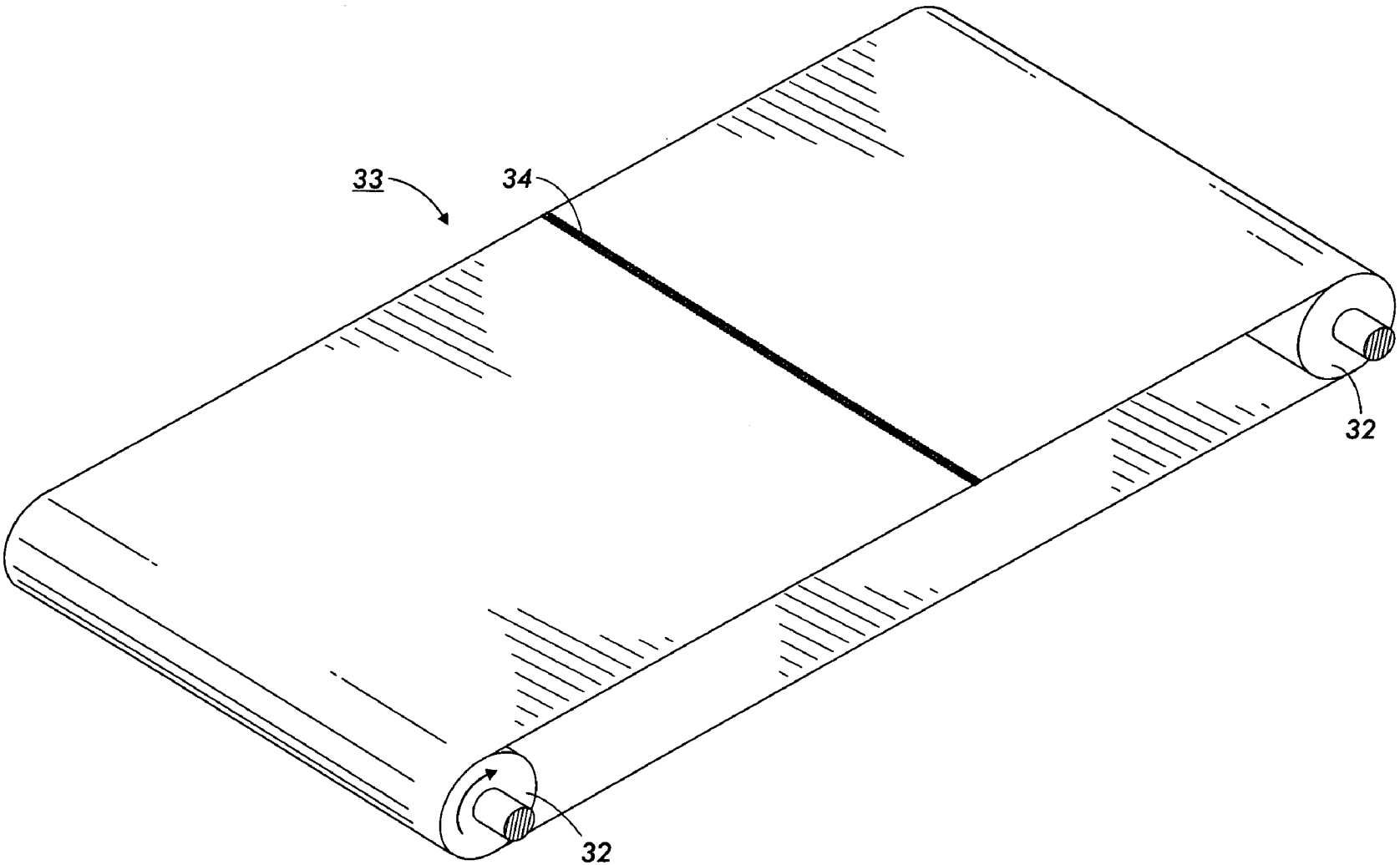
FIG. 5 is an illustration of a weldable belt.

As shown in FIG. 5, the present belt is weldable. FIG. 5 shows intermediate transfer belt 33 with welded seam 34. Belt 33 is positioned around rollers 32. The term "weldable," refers to a material that will melt and adhere to itself, and in embodiments, form a strong mechanical bond. The melting can be induced by direct heating with a warmed platen, indirect heating with infrared lamps, e-beam, a laser, or any other method of irradiation. Seams can also be formed by vibrating the material with an ultrasonic horn to generate the heat to melt the material. The belts are also cost effective because of the lack of requirement for puzzle cut seams, for additional fillers, and for the time-consuming conditioning steps.

The polyaniline filled polyimide substrate can comprise a polyimide having a suitable high tensile modulus, and in embodiments, the polyimide is one that is capable of becoming a conductive film upon the addition of electrically conductive particles. In embodiments, the polyimide is one having a high tensile modulus, because the high tensile modulus optimizes the film stretch registration and transfer conformance.

Several types of thermoplastic, weldable polyimides can be purchased commercially. These include KAPTON®, available from E.I. DuPont, IMIDEX® from West Lake Plastics Company, and the like thermoplastic polyimides. There are several grades of polyimide available for purchase and include HN, FN, MTB, FPC, JB, RR, VN, KJ, JP, and the like. In embodiments, KAPTON® KJ can be used as the polyimide. The KJ grade of polyimide has sufficient oxygen molecules inserted along the backbone of the polymer chain to allow it to rotate and thus, be weldable. In addition, the KJ grade polyimide has a proper conductivity range for toner transfer. Use of polyaniline as the filler can bring the composition into the desired range of resistivity for toner transfer of a weldable intermediate transfer belt.

Most commercially available polyimides do not exhibit a glass transition temperature (Tg), because the polymer decomposed at elevated temperature about 400° C., that is why these polyimides are termed thermoset plastic. Therefore, they cannot be ultrasonically welded into seamed flexible belts. However, modified thermoplastic polyimides are transformed the polyimide from a thermoset plastic into a thermoplastic and can therefore be ultrasonically weldable into seamed belts. Specific examples of suitable thermoplastic polyimides are represented by the following formulas:

wherein n, m and q are numbers and represent the degree of polymerization, and are from about 10 to about 300, or from about 50 to about 125; x and y are numbers and represent the number of segments and are from about 2 to about 10, or from about 3 to about 7; and z is a number and represents the number of repeating units and is from about 1 to about 10, or from about 3 to about 7.

The present belt comprises polyaniline fillers in the thermoplastic polyimide polymer. The use of the present polyaniline dispenses with the need for nanoparticles and/or carbon black and/or other fillers normally necessary in intermediate transfer belts to obtain the desired resistivity. One of the reasons there is no need for additional fillers, is because of the method of reaction between the polyaniline and polyimide, which results in the present polyaniline-filled polyimide weldable belt as a single, homogeneous material. The term "homogeneous" refers to the entire layer having the same average composition as opposed to a device that has distinct layers such as a supporting substrate and a separate conducting layer. However, in embodiments, a filler, such as carbon black, may be added.

The thermoplastic polyimide is present in the polyaniline filled polyimide substrate in an amount of from about 75 to about 98 percent by weight of total solids, or from about 86 to about 95, or from about 90 to about 92 percent by weight of total solids. Total solids include the total percentage by weight (equal to 100%) of polyimide, polyaniline, any additional fillers and any additives in the layer. The polyaniline is present in the polyimide in an amount of from about 2 to about 25 percent, or from about 5 to about 14 percent, or from about 8 to about 10 percent.

In embodiments, the polyaniline has a relatively small particle size of from about 0.5 to about 5.0 microns, or from about 1.1 to about 2.3 microns, or from about 1.2 to about 2.0 microns, or from about 1.5 to about 1.9, or about 1.7 microns. In order to achieve this small particle size, the polyaniline filler may need to be subjected to a grinding step.

(I)

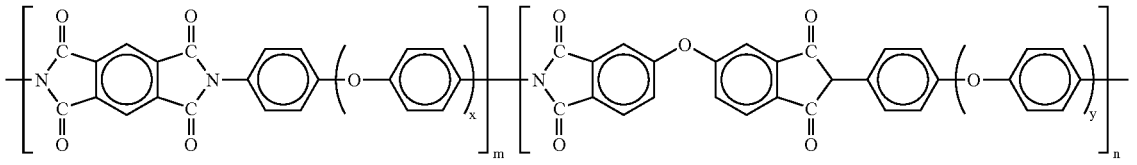

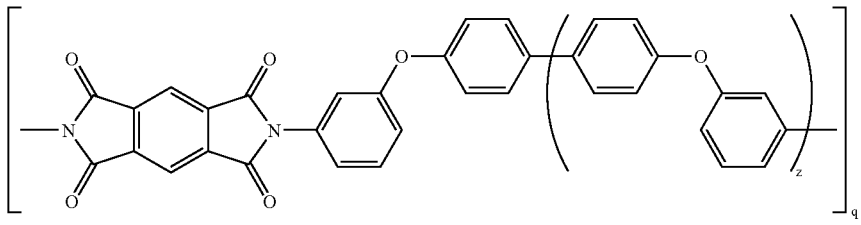

Polyaniline fillers can be purchased commercially from Panipol Oy, Finland, and other vendors.

In embodiments, an additional filler, other than polyaniline can be used, although it is not necessary. In embodiments, a carbon filler, such as carbon black, graphite, fluorinated carbon black, or other carbon fillers, can be used. The amount of carbon black filler in the polyaniline-filled polyimide weldable substrate is from about 1 to about 20 percent, or from about 2 to about 10 percent, or from about 3 to about 5 percent by weight of total solids.

The field sensitivity is from about 0.001 to about 1.0, or from about 0.1 to about 0.5 log ohm/sq.

With known weldable belts, the bulk resistivity and surface resistivity must be set at a certain required state in order for the belt to function properly. The resistivity of the surface cannot be modified without affecting the resistivity of the bulk, and vise versa.

The surface resistivity of the intermediate transfer belt is relatively high and from about 10.5 to about 13.0 log ohm/sq, or from about 11.0 to about 12.5 log ohm/sq, or from about 11.4 to about 12.3 log ohm/sq.

The sheet resistivity of the intermediate transfer weldable belt is from about 10.5 to about 13.0 log ohm/sq, or from about 11.0 to about 12.5 log ohm/sq, or from about 11.4 to about 12.3 log ohm/sq.

The intermediate transfer member can be of any suitable configuration. Examples of suitable configurations include a sheet, a film, a web, a foil, a strip, a coil, a cylinder, a drum, an endless strip, a circular disc, a belt including an endless belt, an endless seamed flexible belt, and an endless seamed flexible belt. The circumference of the component in a film or belt configuration of from 1 to 2 or more layers is from about 250 to about 2,500 mm, or from about 1,500 to about 2,500 mm, or from about 2,000 to about 2,200 mm. The width of the film or belt is from about 100 to about 1,000 mm, or from about 200 to about 500 mm, or from about 300 to about 400 mm.

measured with commercial equipment such as the Micro-TR1 -gloss instrument from BYK Gardner.

The weldable belt, in embodiments, has a smooth seam. An advantage is that the blade cleaning over the smooth surface is much better than over a bumpy surface or bumpy seam. This smooth surface can also be achieved, in embodiments, by adding a coating on the belt over the seam, forming an imageable seam coating.

The mechanical properties of adhesion and surface roughness of this imageable seam coating can be achieved with polyvinyl chloride. The properties of PVC can be further tuned by modification of the molecular weight, the functional groups, or by the addition of a co-polymer. The electrical properties of the imageable seam coating are achieved by the addition of a conductive polymer such as polyaniline.

Specific embodiments will now be described in detail. These examples are intended to be illustrative, and the invention is not limited to the materials, conditions, or process parameters set forth in these embodiments. All parts are percentages by weight of total solids unless otherwise indicated.

EXAMPLES

EXAMPLE 1

Preparation of Weldable KAPTON® KJ Thermoplastic Polyaniline Filled Polyimide Intermediate Transfer Belts A flexible seamed polyimide belt was prepared, using a rectangular cut sheet of a 3-mil thick KAPTON® KJ, a thermoplastic polyimide having a thermal contraction coefficient of $6.2\times10^{-5}$/° C., a Glass Transition Temperature (Tg) of 210° C. (available from E.I. Du Pont de Numours and Company), by overlapping the 2opposite ends and ultrasonically welded, using 40 KHz frequency, into a seamed flexible polyimide belt. The molecular structure of this Polyimide is given in formula (I) below:

(I)

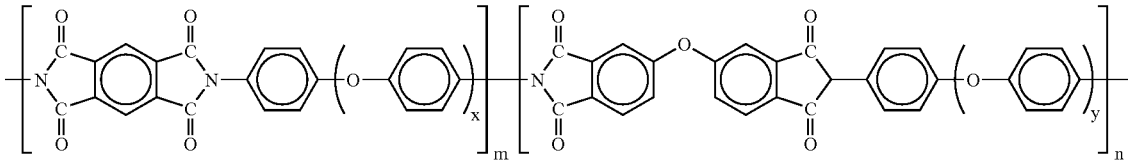

Roughness can be characterized by microgloss, wherein a rougher surface has a lower microgloss than a smoother surface. The microgloss values of the weldable polyaniline filled polyimide intermediate transfer belt from about 85 to about 110 gloss units, or from about 90 to about 105 gloss units, or from about 93 to about 98 gloss units. These measurements were taken at an 85° angle. An additional benefit of the polyaniline-filled polyimide weldable belt is that such an improved surface gloss achieved by the belt cannot be achieved when certain fillers other than polyaniline, for example, nanoparticles, are added to the polymer blend. The present belt, in embodiments, achieved the desired high gloss level without the need for additional fillers. Microgloss is a measure of the amount of light reflected from the surface at a specific angle and can be wherein, x=2 and y=2; and m and n are from about 10 to about 300.

EXAMPLE 2

Preparation of Weldable IMIDEX® Thermoplastic Polyimide Intermediate Transfer Belts Another flexible polyimide seamed belt was prepared in accordance to the seamed welding procedures described in Example 1, except that an alternate 3-mil thick thermoplastic polyimide, IMIDEX® (available from West Lake Plastics Company), having a thermal contraction coefficient of $6.1\times10^{-5}$/° C., a Glass Transition Temperature (Tg) of 230° C., was used as the substrate. The molecular structure of IMIDEX® polyimide is shown in formula (II) below:

(II)

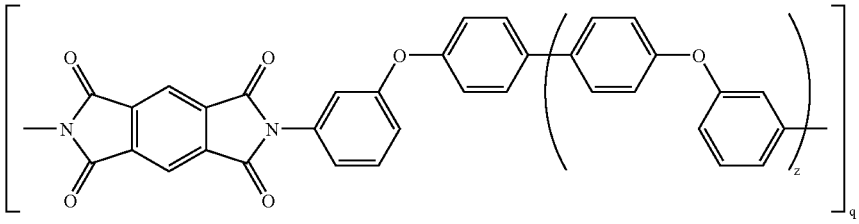

wherein z=1, and q is from about 10 to about 300.

EXAMPLE 3

Preparation of Known Thermoset Polyimide Intermediate Transfer Belts

Commercially available polyimides, such as KAPTON® F, H, and R types available from DuPont and UPILEX® R and S types available from Ube Industries, LTD are thermoset polyimide and have excellent temperature stability beyond 400° C. The molecular structures of these thermoset polyimide substrates are presented in the following formulas (III), (IV), and (V):

(III)

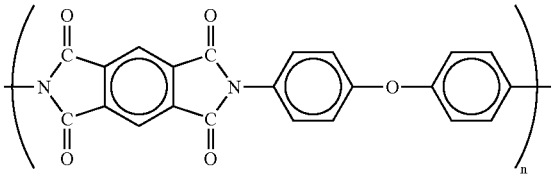

(IV)

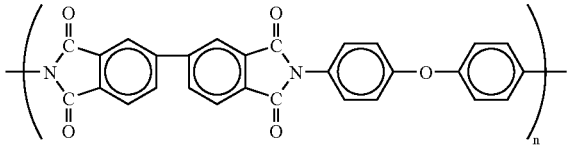

(V)

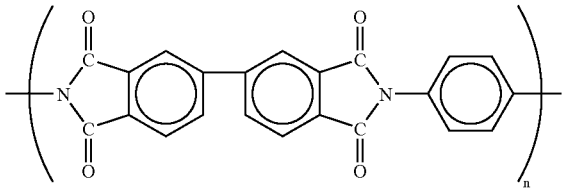

where n is a number of from about 10 to about 300.

With a thermal contraction coefficient of about $1.7\times10^{-5}$/° C. to about $2.5\times10^{-5}$/° C., it is almost 3.5 times greater than that of the KAPTON® KJ or IMIDEX®. The above polyimides are thermoset plastics, so they cannot conveniently be ultrasonically welded into seamed flexible belts.

EXAMPLE 4

Preparation of Puzzle Cut Polyaniline Filled KAPTON® JP Polyimide Intermediate Transfer Belts Known polyaniline filled polyimide intermediate transfer belts were prepared using a rectangular cut sheet of DuPont CPB-315 comprising 72.4% KAPTON® JP polyimide polymer, 17.9% polyaniline, and 9.7% ZELEC® (antimony doped tin oxide, by puzzle cutting opposite ends, mating these ends together, and compressing heated adhesive into the mated ends to form a seamed flexible polyimide belt. This belt is such that without a conditioning step, the belt electrical resistivity will not be stable for several months.

EXAMPLE 5

Preparation of Weldable Polyaniline Filled Thermoplastic Polyimide Intermediate Transfer Belts A weldable intermediate transfer belt was prepared as follows. A sample was cut to a size of 362 mm wide by 2110.8 mm long. The ends were overlapped by one millimeter and an ultrasonic horn was used to compress the material against a steel welding platen, melting the material in the overlap region and creating a seam. The resulting belt was 362 mm wide and 2,110.8 mm in circumference. The intermediate transfer belt comprised 91% KAPTON® KJ and 9% polyaniline. The polyaniline had a particle size of 1.7 microns.

The weldable belt was print tested in DC2045, DC5252, and DC6060 machines. These are Xerox Docucolor® machines. The results of the testing are shown in Table 1 below. The sheet resistivity was measured at 72° F. and 55% relative humidity and at 0.14 V/μm. Field sensitivity is the difference in sheet resistivity measured at 0.014V/μm and 0.14V/μm. The resulting belt was 362 mm wide by 2,110.8 mm in circumference.

The weldable belt met image quality specifications and ran to over 370,000 prints in 72° F. and at 10% relative humidity.

TABLE 1

| Property | Puzzle Cut Polyaniline filled Polyimide of Example 4 | Weldable Polyaniline filled Polyimide of Example 5 |
|---|---|---|
| KAPTON ® polymer | 72.4% (JP) | 91% (KJ) |
| Polyaniline (PAN) | 17.9% | 9% |
| ZELEC ® | 9.7% | 0 |
| Ave. PAN particle size | | 1.7 microns |
| Sheet Resistivity | 12.5 log ohm/sq | 11.4–11.8 log ohm/sq |
| Field Sensitivity | 0.01 | 0.02 |
| Microgloss | 95–100 | 93–99 |

EXAMPLE 6

Conditioning Trials for Weldable Intermediate Transfer Belts

Figure 4:
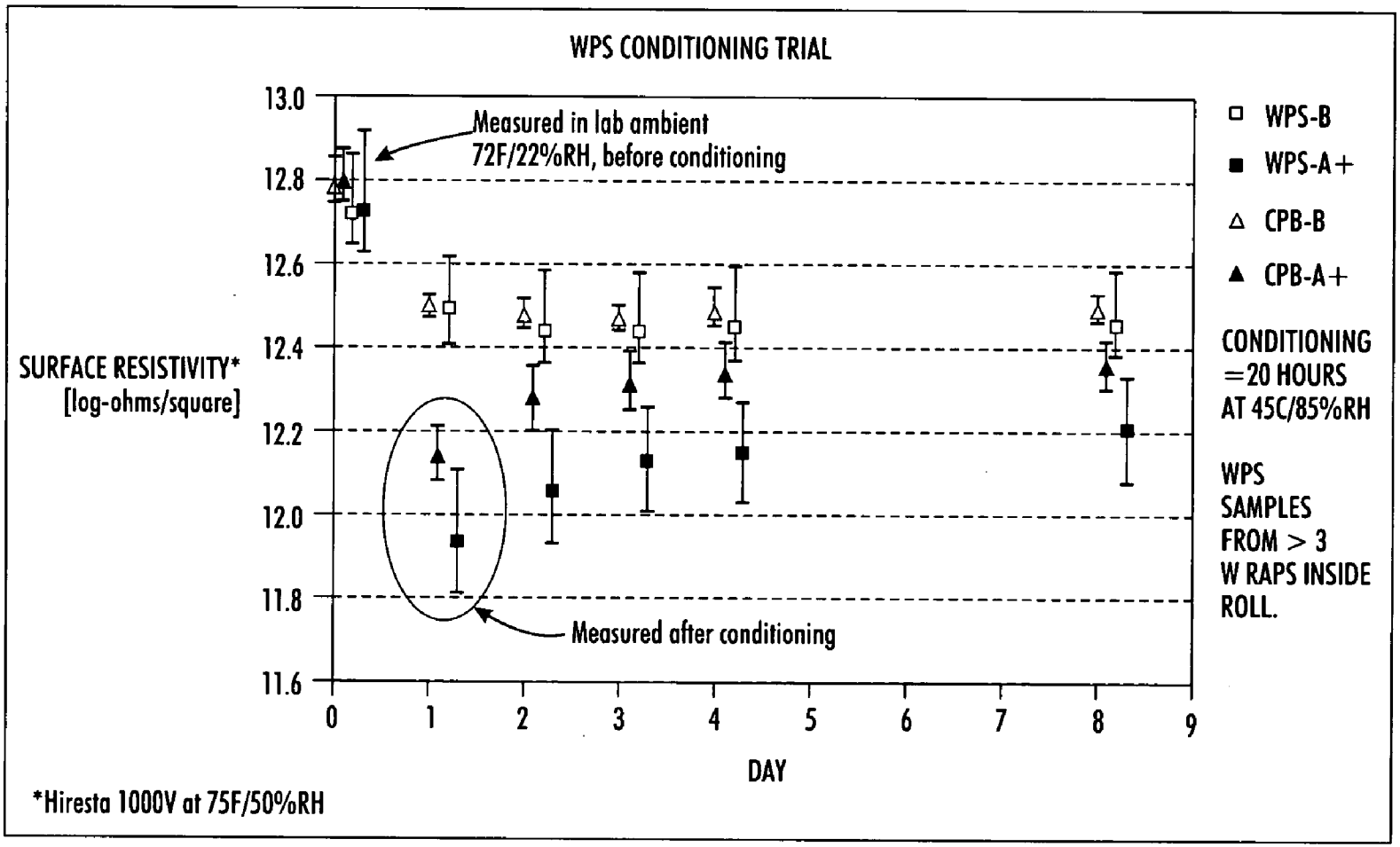
FIG. 4 is a graph of surface resistivity versus days, and demonstrates that the weldable belt, in embodiments, does not need conditioning.

Conditioning trials for weldable intermediate transfer belts were accomplished as follows. FIG. 4 demonstrates that unconditioned weldable intermediate transfer belts subjected to conditioning have a similar resistivity response as previously conditioned puzzle cut polyaniline filled polyimide belts. Because the conditioning step completes a non-reversible chemical reaction, once a belt has been conditioned any additional conditioning will have no permanent effect. Thus, if unconditioned belts behave similar to conditioned belts, then the conclusion can be drawn that the reaction is complete, and further conditioning is unnecessary. Shown in open triangles and closed triangles, the previously conditioned puzzle cut polyaniline filled polyimide belts of Example 4 behaves in the same fashion as the weldable material which is shown in open and closed squares. Therefore, the conclusion is drawn that conditioning of weldable intermediate transfer belts is unnecessary.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

What is claimed is:

1. A weldable intermediate transfer belt comprising a substrate comprising a homogeneous composition comprising polyaniline in an amount of from about 2 to about 25 percent by weight of total solids, and thermoplastic polyimide in an amount of from about 75 to about 98 percent by weight of total solids, wherein said polyaniline has a particle size of from about 0.5 to about 5.0 microns, wherein said thermal polyimide has a structure selected from the group consisting of Formulas I and II (I)

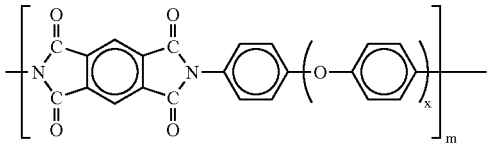

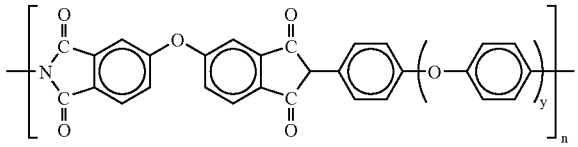

wherein, x and y are numbers and each is from about 2 to about 10, and m and n are numbers and each are from about 10 to about 300, and (II)

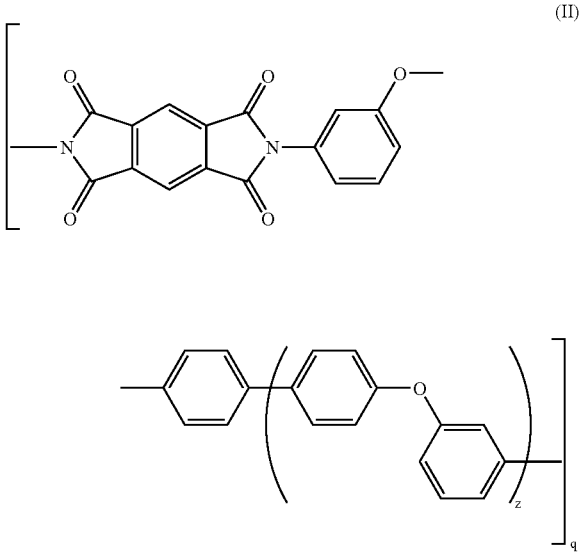

wherein z is a number of from about 2 to about 10, and q is a number of from about 10 to about 300.

2. A weldable intermediate transfer belt in accordance with claim 1, wherein said particle size is from about 1.1 to about 2.3 microns.

3. A weldable intermediate transfer belt in accordance with claim 2, wherein said particle size is from about 1.2 to about 1.7 microns.

4. A weldable intermediate transfer belt in accordance with claim 1, wherein said polyaniline is present in an amount of from about 5 to about 14 percent by weight based on the weight of total solids.

5. A weldable intermediate transfer belt in accordance with claim 4, wherein said polyaniline is present in an amount of from about 8 to about 10 percent by weight of total solids.

6. A weldable intermediate transfer belt in accordance with claim 1, wherein said belt has a surface resistivity of from about $3.16\times10^{10}$ to about $1\times10^{13}$ ohm/sq.

7. A weldable intermediate transfer belt in accordance with claim 6, wherein said surface resistivity is from about $1\times10^{11}$ to about $3.16\times10^{12}$ ohm/sq.

8. A weldable intermediate transfer belt in accordance with claim 7, wherein said surface resistivity is from about $2.51\times10^{11}$ to about $2\times10^{12}$ ohm/sq.

9. A weldable intermediate transfer belt in accordance with claim 1 wherein said substrate further comprises carbon black filler.

10. A weldable intermediate transfer belt in accordance with claim 9, wherein said carbon black filler is present in the substrate in an amount of from about 1 to about 20 percent by weight of total solids.

11. A weldable intermediate transfer belt in accordance with claim 1, wherein said intermediate transfer belt has a sheet resistivity of from about $3.16\times10^{10}$ to about $1\times10^{13}$ ohm/sq.

12. A weldable intermediate transfer belt in accordance with claim 11, wherein said sheet resistivity is from about $1\times10^{11}$ to about $3.16\times10^{12}$ ohm/sq.

13. A weldable intermediate transfer belt in accordance with claim 1, wherein said intermediate transfer belt has a microgloss of from about 85 to about 110 gloss units.

14. A weldable intermediate transfer belt in accordance with claim 13, wherein said microgloss is from about 90 to about 105 gloss units.

15. A weldable intermediate transfer belt in accordance with claim 14, wherein said microgloss is from about 93 to about 98 gloss units.

16. A weldable intermediate transfer belt in accordance with claim 1, wherein said intermediate transfer belt has a field sensitivity of from about to about 0.1 to about 0.5 ohm/sq.

17. A weldable intermediate transfer belt in accordance with claim 1, further comprising an outer release layer positioned on said substrate.

18. A weldable intermediate transfer belt in accordance with claim 17, wherein said release layer comprises polyvinyl chloride.

19. A weldable intermediate transfer belt in accordance with claim 1, wherein said intermediate transfer belt has a circumference of from about 250 to about 2,500 mm.

20. A weldable intermediate transfer belt comprising a substrate comprising a homogeneous composition consisting essentially of polyaniline in an amount of from about 2 to about 25 percent by weight of total solids, and a thermoplastic polyimide in an amount of from about 75 to about 98 percent by weight of total solids, and wherein said polyaniline has a particle size of from about 0.5 to about 5.0 microns, wherein said thermal polyimide has a structure selected from the group consisting of the following Formulas I and II (I)

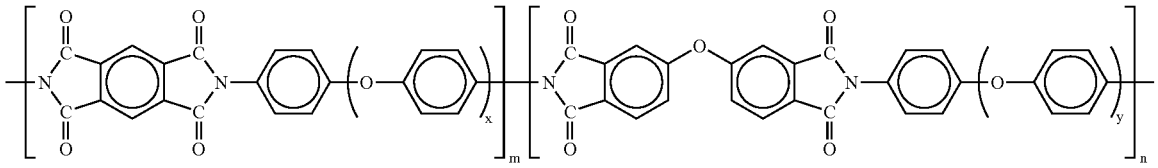

wherein, x and y are numbers and each is from about 2 to about 10, and m and n are numbers and each are from about 10 to about 300, and (II)

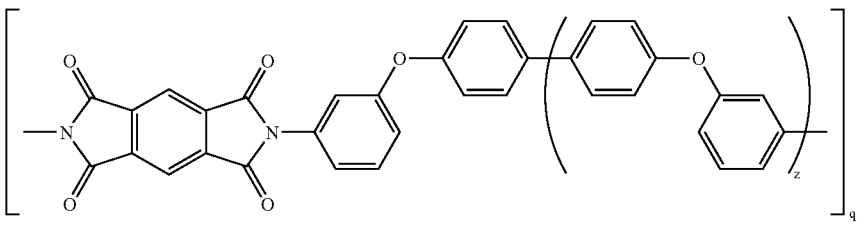

wherein z is a number of from about 2 to about 10, and q is a number of from about 10 to about 300.

21. An apparatus for forming images on a recording medium comprising:

a charge-retentive surface to receive an electrostatic latent image thereon;

a development component to apply toner to said charge-retentive surface to develop said electrostatic latent image and to form a developed image on said charge retentive surface;

weldable intermediate transfer belt to transfer the developed image from said charge retentive surface to a substrate, wherein said intermediate transfer belt comprises a substrate comprising a homogeneous composition comprising polyaniline in an amount of from about 2 to about 25 percent by weight of total solids, and a thermoplastic polyimide in an amount of from about 75 to about 98 percent by weight of total solids, and wherein said polyaniline has a particle size of from about 0.5 to about 5.0 microns, wherein said thermal polyimide has a structure selected from the group consisting of the following Formulas I and II (I)
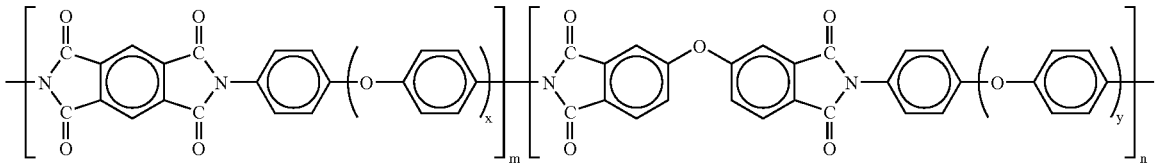
wherein, x and y are numbers and each is from about 2 to about 10, and m and n are numbers and each are from about 10 to about 300,
and
(II)
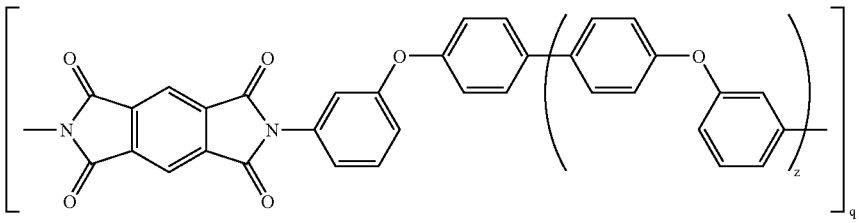
wherein z is a number of from about 2 to about 10, and q is a number of from about 10 to about 300; and
a fixing component.
* * * * *